US006092258A

United States Patent [19]

Chen

[11] Patent Number: 6,092,258

[45] Date of Patent: Jul. 25, 2000

[54] BATH BRUSH

[76] Inventor: Ching-Chen Chen, No. 552 Kuang Fu Rd., Pei Tou, Chang Hua Hsien, Taiwan

[21] Appl. No.: 09/271,146

[22] Filed: Mar. 17, 1999

[51] Int. Cl.[7] ..... A47K 7/02

[52] U.S. Cl. ..... 15/209.1; 15/229.11; 15/229.13

[58] Field of Search ..... 15/209.1, 210.1, 15/229.11, 229.13

[56] References Cited

U.S. PATENT DOCUMENTS

| | | | |
|---|---|---|---|
| 4,190,921 | 3/1980 | Rose | 15/229.11 |
| 5,758,386 | 6/1998 | Chen | 15/229.11 |
| 5,944,032 | 8/1999 | Masterson | 15/229.11 |

FOREIGN PATENT DOCUMENTS

| | | | |
|---|---|---|---|
| 1021209 | 2/1953 | France | 15/229.11 |

*Primary Examiner*—Randall E. Chin
*Attorney, Agent, or Firm*—Dougherty & Troxell

[57] ABSTRACT

A bath brush including an elastic mesh tube, a grip member and a binding member. The mesh tube is axially squeezed and compressed, whereby the circumference thereof is continuously waved and crimped. The grip member is disposed on an outer side of the elastic mesh tube and formed with a first fixing portion and a second fixing portion spaced from each other by a predetermined distance and at least one third fixing portion between the first and second fixing portions. The binding member has a predetermined length and flexibility and is formed with a first and a second binding sections spaced from each other by a predetermined distance, a pressing section between the first and second binding sections and at least one third binding section disposed on the pressing section. The number of the third binding section corresponds to the number of the third fixing portion. The first binding section serves to fix a part of one end of the mesh tube on the first fixing portion and the second binding section serves to fix a part of the other end of the mesh tube on the second fixing portion, while the pressing section serves to press a middle portion of the mesh tube against a section of the grip member between the first and second fixing portions. The third binding section serves to fix the pressing section on the corresponding third fixing portion. Accordingly, the elastic mesh tube is compressed by the binding member into an elongated shape and fixed on the grip member for facilitating operation and achieving better cleaning effect.

14 Claims, 7 Drawing Sheets

BATH BRUSH

BACKGROUND OF THE INVENTION

The present invention relates to a bath brush which includes an elongated cleaning section and a grip section. The cleaning section is made of soft mesh material so as to achieve a comfortable feeling and better cleaning effect.

Many types of bath brushes have been developed. For example, there is an improved bath brush in which multiple elongated boot-shaped elastic meshes are respectively compressed into short boot-shaped meshes with waved peripheries and then the boot-shaped elastic meshes are axially parallelly connected with each other to form a long string.

Such strap-like bath brush has a certain length and resilience for a user to use in bathing. However, in the manufacturing procedure of such bath brush, the edge sections of each two adjacent elastic meshes are repeatedly adjoined with each other. Therefore, the meshes are excessively overlapped at the conjunction and forcedly compressed and bound. As a result, the respective conjunctions will be quite hard and when contacting with the skin of a user, the user will feel uncomfortable.

Moreover, the strap-like bath brush is entirely soft without any grip section. Therefore, a user must hold two ends of the bath brush with both hands. This is inconvenient for the user.

Another type of bath brush with a grip is commercially available. Such bath brush is equipped with a ball-shaped cleaning brush fixed at the end of the grip. In use, such bath brush can cover only a quite limited area of a user's skin. Therefore, the comfortable feeling and cleaning effect are limited.

SUMMARY OF THE INVENTION

It is therefore a primary object of the present invention to provide a bath brush which can be easily manufactured and assembled so that the manufacturing cost is greatly reduced.

It is a further object of the present invention to provide the above bath brush which is able to achieve a more comfortable feeling in use.

According to the above objects, the bath brush of the present invention includes an elastic mesh tube, a grip member and a binding member. The mesh tube is axially squeezed and compressed, whereby the circumference thereof is continuously waved and crimped. The grip member is disposed on an outer side of the elastic mesh tube and formed with a first fixing portion and a second fixing portion spaced from each other by a predetermined distance and at least one third fixing portion between the first and second fixing portions. The binding member has a predetermined length and flexibility and is formed with a first and a second binding sections spaced from each other by a predetermined distance, a pressing section between the first and second binding sections and at least one third binding section disposed on the pressing section. The number of the third binding section corresponds to the number of the third fixing portion. The first binding section serves to fix a part of one end of the mesh tube on the first fixing portion and the second binding section serves to fix a part of the other end of the mesh tube on the second fixing portion, while the pressing section serves to press a middle portion of the mesh tube against a section of the grip member between the first and second fixing portions. The third binding section serves to fix the pressing section on the corresponding third fixing portion. Accordingly, the elastic mesh tube is compressed by the binding member into an elongated shape and fixed on the grip member for facilitating operation and achieving better cleaning effect.

The present invention can be best understood through the following description and accompanying drawings wherein:

DETAILED DESCRIPTION OF THE PREFERRED EMBODIMENTS

Figure 1:
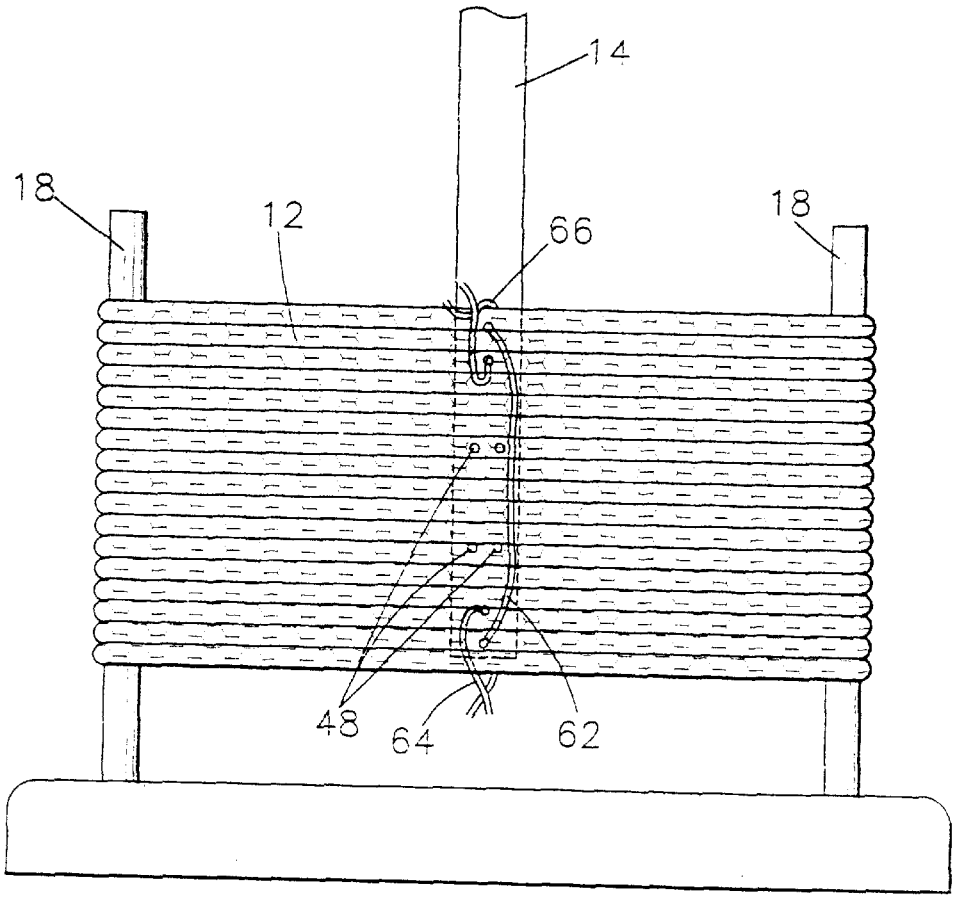
FIG. 1 is a front view of a first embodiment of the present invention in manufacturing.

Please refer to FIGS. 1 to 4. The bath brush 10 of the present invention is composed of one single tubular elastic mesh 12, a grip member 14 and several binding members 16 for combining the elastic mesh 12 with the grip member 14.

The elastic mesh tube 12 is made of plastic material by integral molding, having a certain length, size and resilience and formed with multiple meshes over the mesh tube 12. In manufacturing, the axial hole of the mesh tube 12 is transversely expanded and downward fitted around two rod members 18 spaced from each other by a certain distance. The part of the elastic mesh tube 12, which still extends outward from upper ends of the rod members 18 is continuously downward pushed. Under such circumstance, the circumference of the mesh tube 12 is squeezed to form continuous waved crimps along the rod members 18. Also, the entire shape of the mesh tube is such changed that the length is shortened, while the transverse width is enlarged to form a short boot pattern.

The grip member 14 has a certain length, including a flat board section 40 and a handle section 42. The flat board section 40 is lengthwise sequentially disposed with a first fixing portion 44, a second fixing portion 46 and a pair of third fixing portions 48 positioned between the first and second fixing portions 44, 46 and spaced therefrom by a certain distance. Each of the first and second fixing portions is formed by two through holes.

The binding members 16 according to the fixing port ions thereof can be divided into a first binding member 64, a second binding member 66, a pressing binding member 62 and a pair of third binding members 68.

Figure 2:
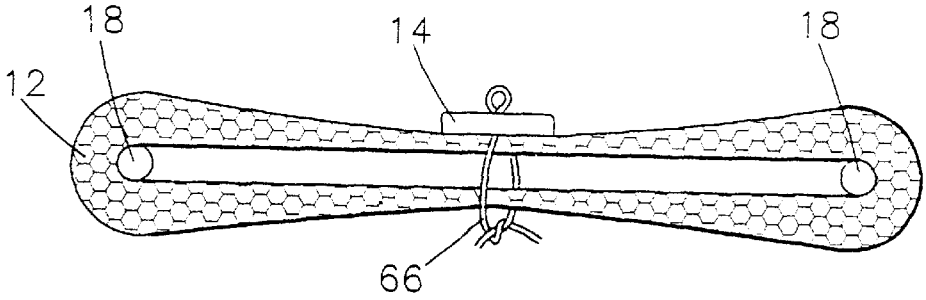
FIG. 2 is a top view of the first embodiment according to FIG. 1.
Figure 3:
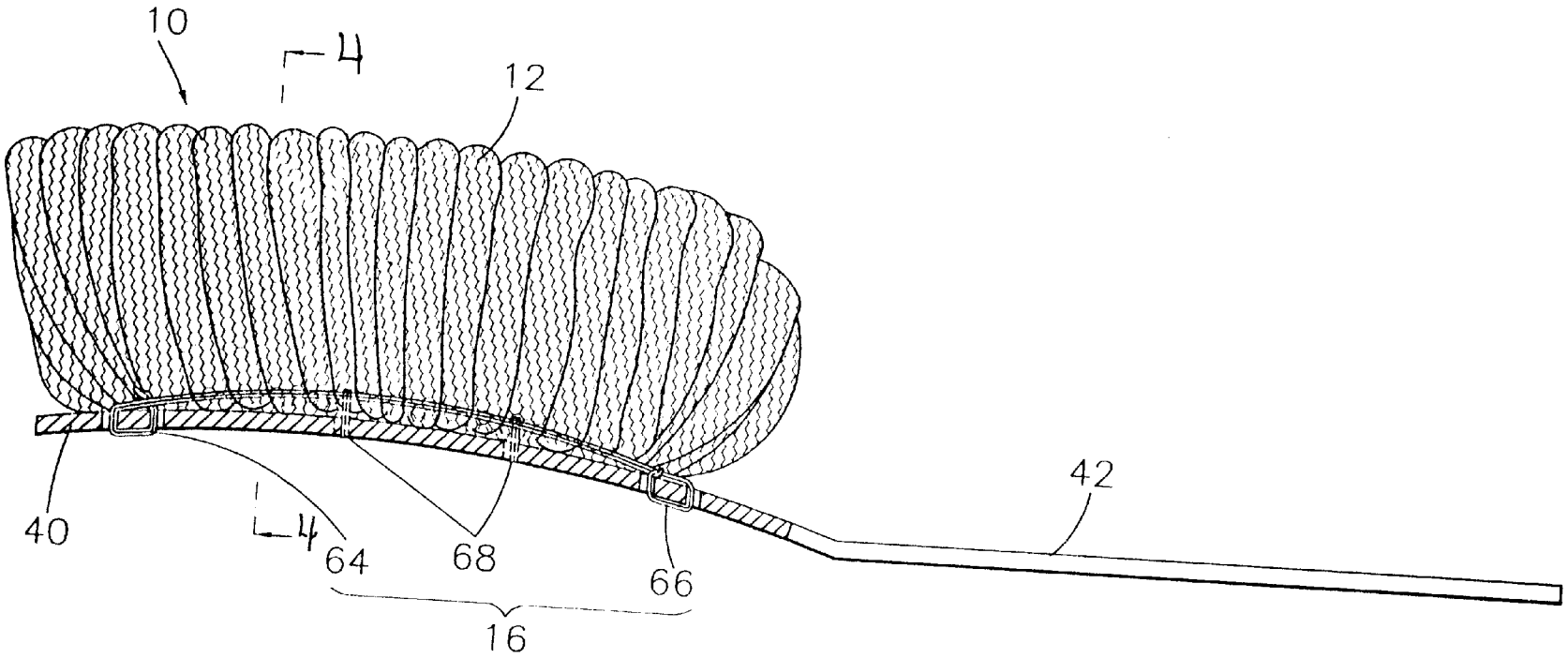
FIG. 3 is a side view of the first embodiment of the present invention.

When assembled, with the length of the grip member 14 parallel to the axis of the mesh tube 12, the flat board section 40 of the grip member 14 is leant against an outer side of the mesh tube 12 (as shown in FIGS. 1 and 2). Then a first binding member 64 and a second binding member 66 are used to respectively circle a part of the upper and lower ends of the mesh tube 12. Then two ends of each of the first and second binding members are passed through the corresponding through holes of the first and second fixing portions 44, 46 to meet and adjoin with each other on the other side of the flat board section 40. Then the pressing binding member 62 is such used that two ends thereof are connected with the first and second fixing portions 44, 46 or the first and second binding members 64, 66. Finally, the two third binding members 68 are used to press a middle portion of the pressing binding member 62 together with the mesh tube 12 against the lateral sides of the flat board section 40.

Figure 4:
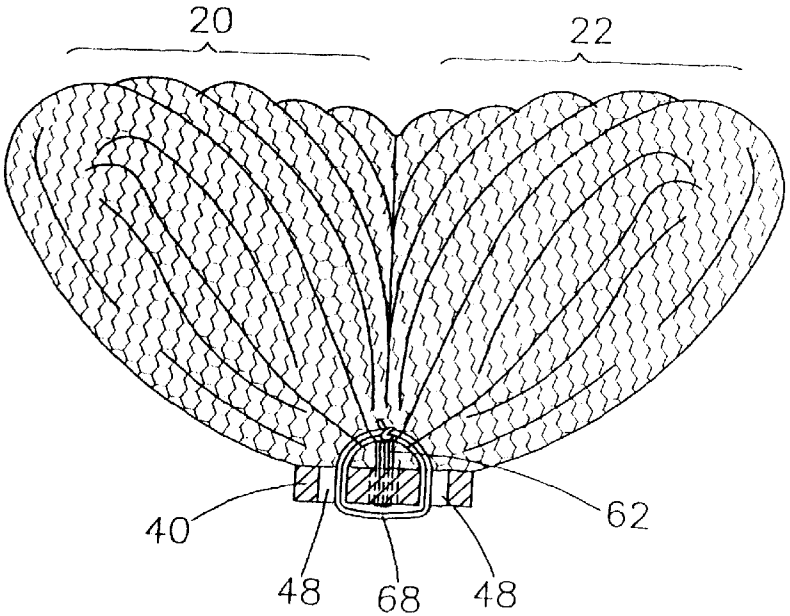
FIG. 4 is a sectional view taken along line 4—4 of FIG. 3.

Accordingly, after the mesh tube 12 and the grip member 14 fixed thereon are removed from the rod members 18, the mesh tube 12 is kept in a form of elongated strap on the flat board section 40. Under such circumstance, the left and right sections 20, 22 of the mesh tube 12 separated by the pressing binding member 62 are expanded with the respective binding members 16 as the center (as shown in FIG. 4.).

In the above embodiment, there are five binding members 16. However, in order to facilitate the continuous manufacturing operation, a longer binding member can be used instead of the first, second and third binding members and the pressing binding member 62, 64, 66, 68. The longer binding member is formed with a first, a second and a third binding sections and a pressing section respectively corresponding to the fixing portions.

Figure 5:
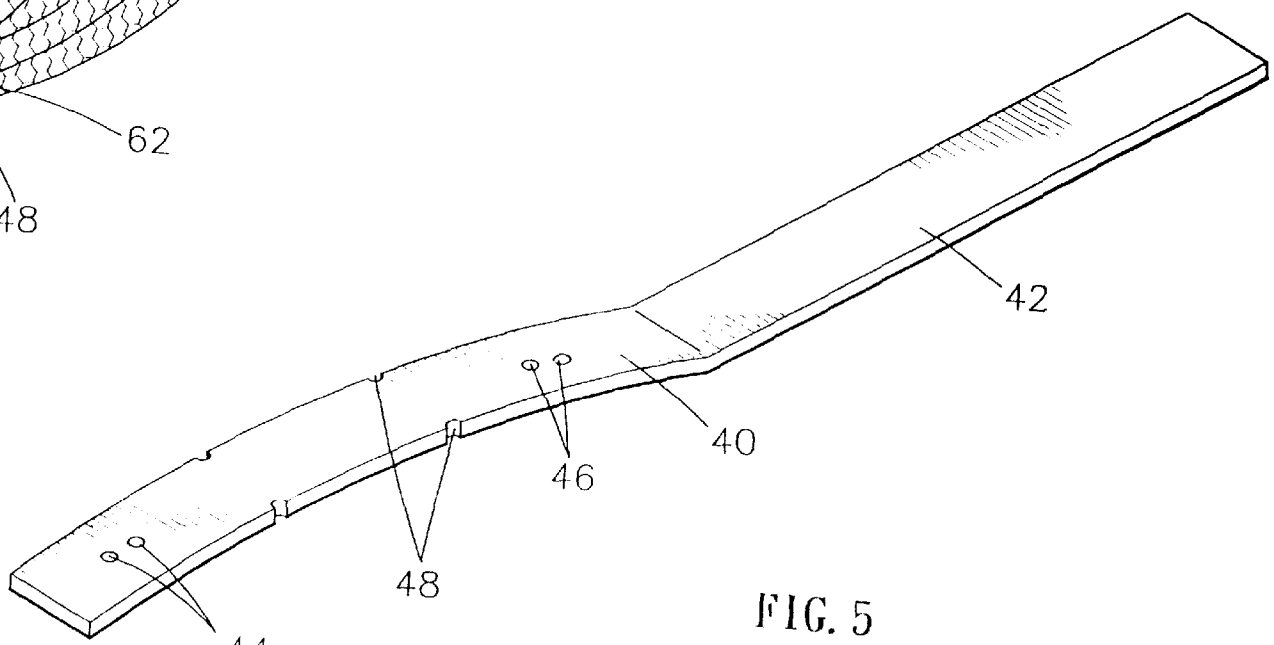
FIG. 5 is a perspective view of the grip member of a second embodiment of the present invention.

Referring to FIG. 5, the third fixing portions 48 of the flat board section 40 are preferably through holes. However, in practice, the third fixing portions can be notches formed on two sides of the flat board section 40, which also can achieve very good fixing effect.

Figure 6:
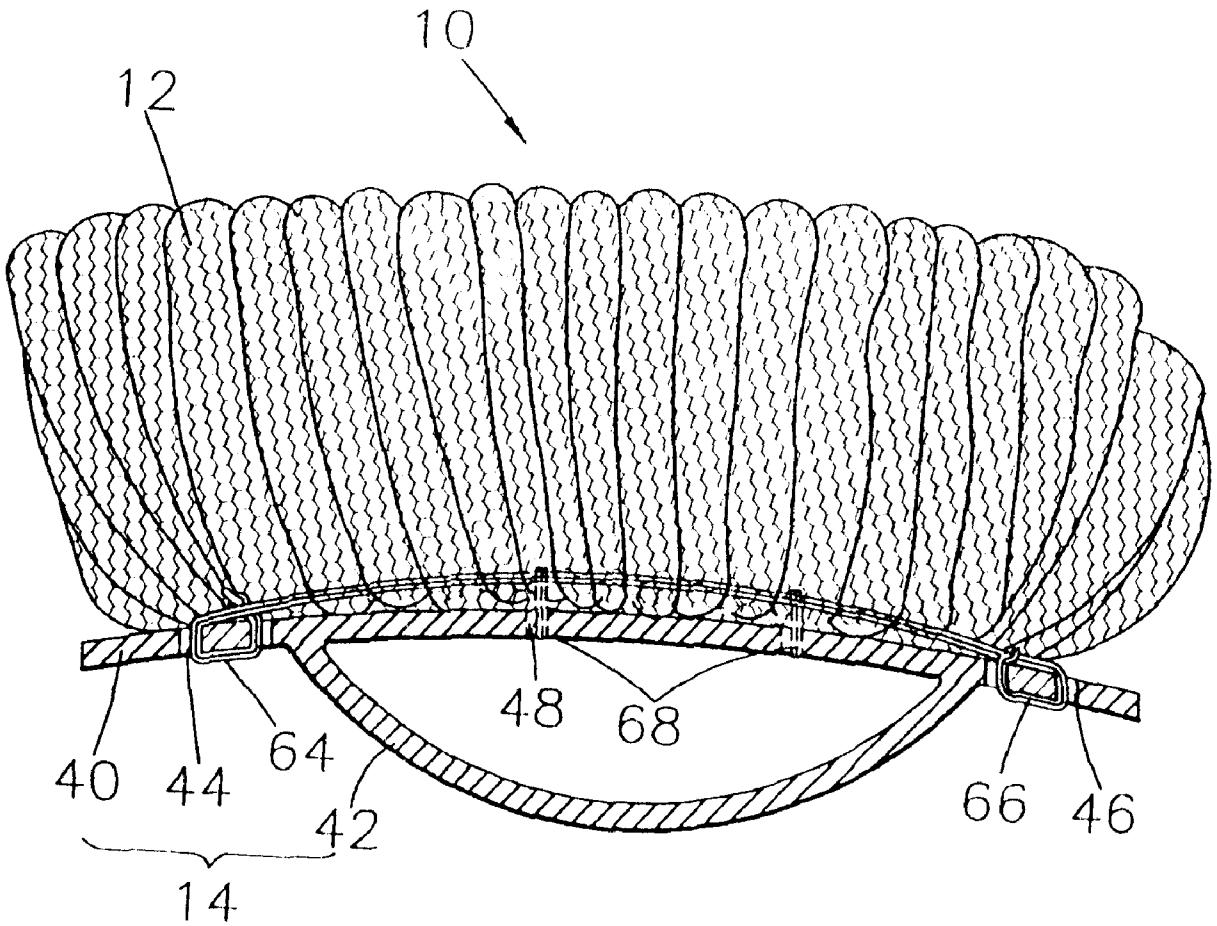
FIG. 6 is a side view of a third embodiment of the present invention.

In addition, the handle sect ion 42 can be alternatively formed with an arch shape instead of the strip shape extending from one end of the flat board section 40. Two ends of the arch handle 42 are respectively fixedly connected with two ends of the flat board section 40 (as shown in FIG. 6). In consideration of the convenience in conduction of the binding members 16 through the first and second fixing portions 44, 46, preferably, the two ends of the handle section 42 are connected to the sections between the first and second fixing portions 44, 46 and the third fixing portions 48.

Figure 8:
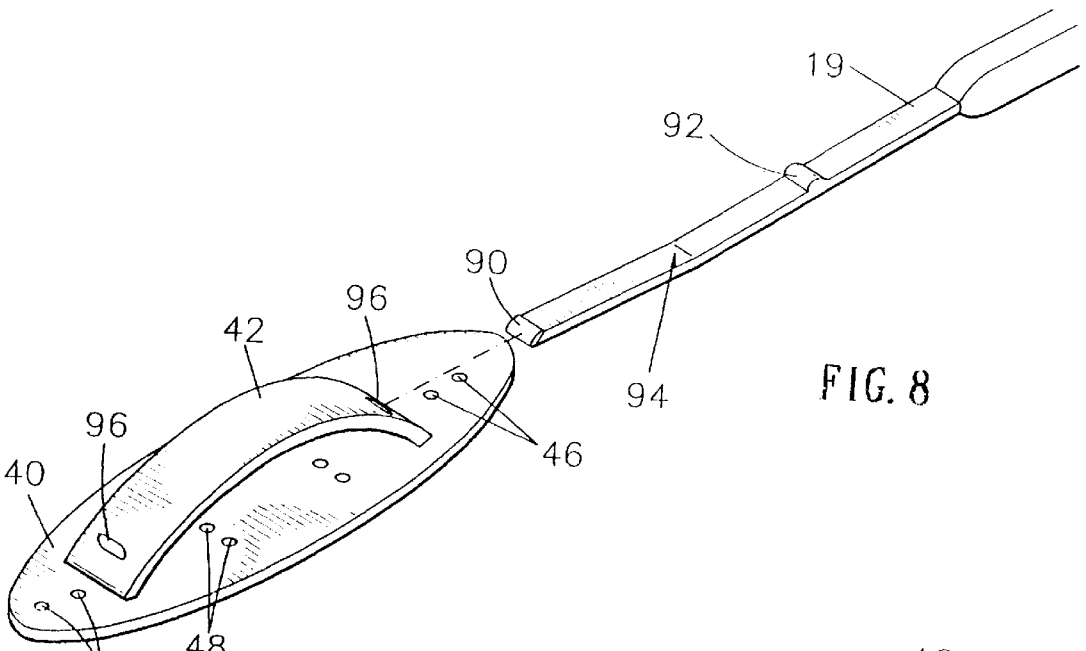
FIG. 8 is a perspective exploded view of the grip member of the fourth embodiment of the present invention.
Figure 7:
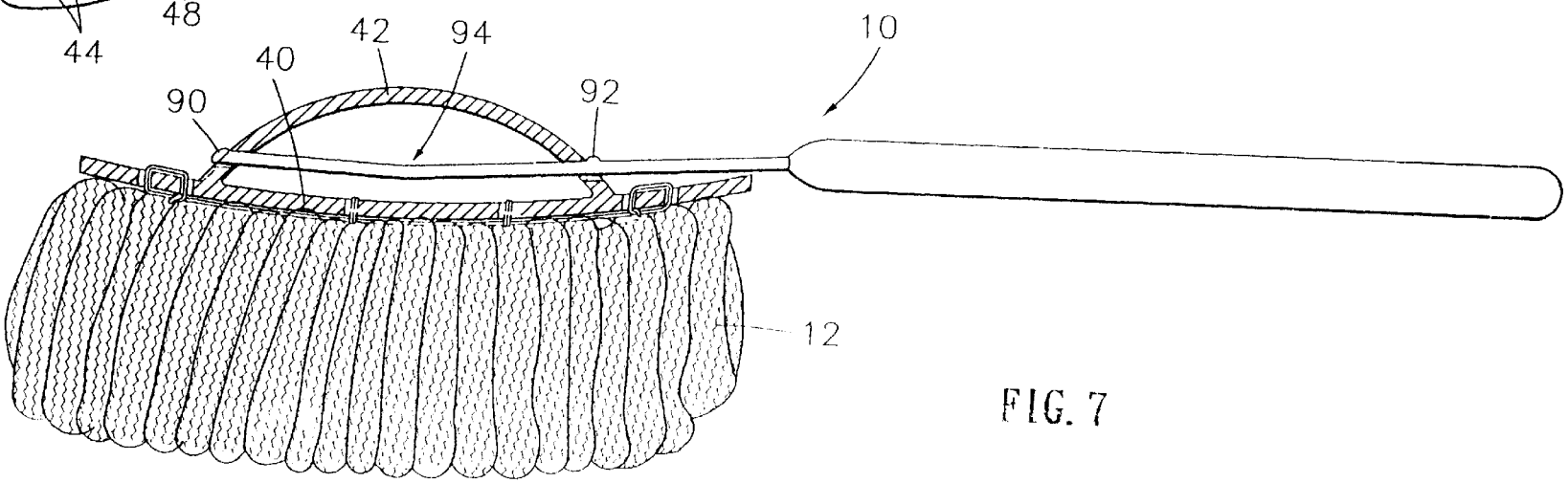
FIG. 7 is a lengthwise sectional view of a fourth embodiment of the present invention.

Referring to FIGS. 7 and 8, in addition to the arch handle section 42, the grip member 14 can be further equipped with a freely detachable extension bar 19. The extension bar 19 is made of slightly resilient material and formed with two projections 90, 92 spaced by a certain distance and a bending section 94 between the projections 90, 92. Each end of the arch handle section 42 is formed with a through hole 96. A part of the extension bar 19 can be passed through the through holes 96 with the bending section 94 positioned on inner side of the handle section 42. At this time, the projections 90, 92 respectively abut against outer sides of two ends of the handle section 42 and by means of the resilience of the bending section 94, the extension bar 19 can be firmly engaged with the grip member 14, providing an alternatively longer grip member for a user. When it is desired to remove the extension bar 19, the smaller projection 90 is pressed down and retracted into the corresponding through hole 96. At this time, the user can easily draw the extension bar 19 out of the arch handle section 42.

Figure 9:
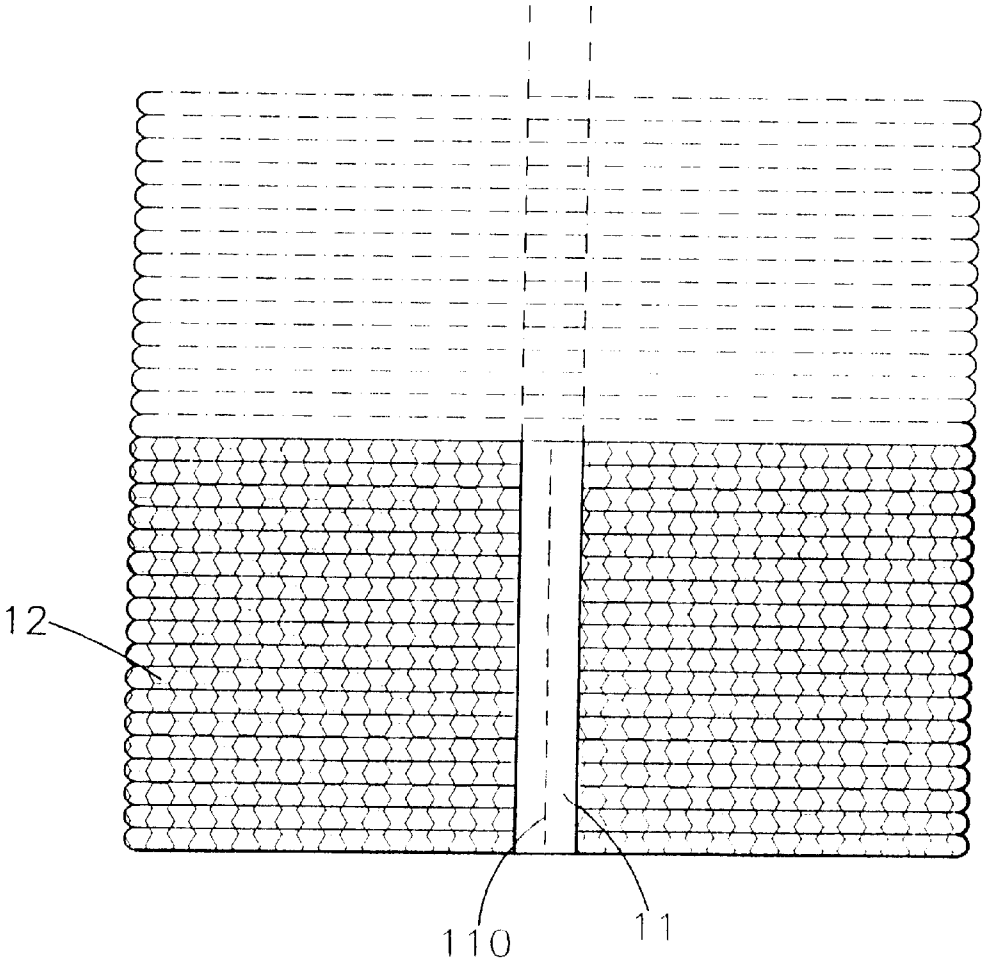
FIG. 9 is a front view of the elastic mesh of a fifth embodiment of the present invention.

Referring to FIG. 9, a thin cloth 11 with a certain flexibility is fixedly seamed on the crimped lateral sides of the elastic mesh 12 with a cotton string 110. When assembled, an operator can cut off a certain length of elastic mesh 12 and then fix the elastic mesh 12 on a grip member 14 in the above manner. By means of the thin cloth 11, the operator can previously manufacture a great amount of crimped elastic meshes 12 with a machine and freely cut off a certain length of the elastic mesh 12 in accordance with the size and length of the desired bath brush and then fix the elastic mesh on the grip member 14. Accordingly, the manufacturing procedure is simplified.

Figure 10:
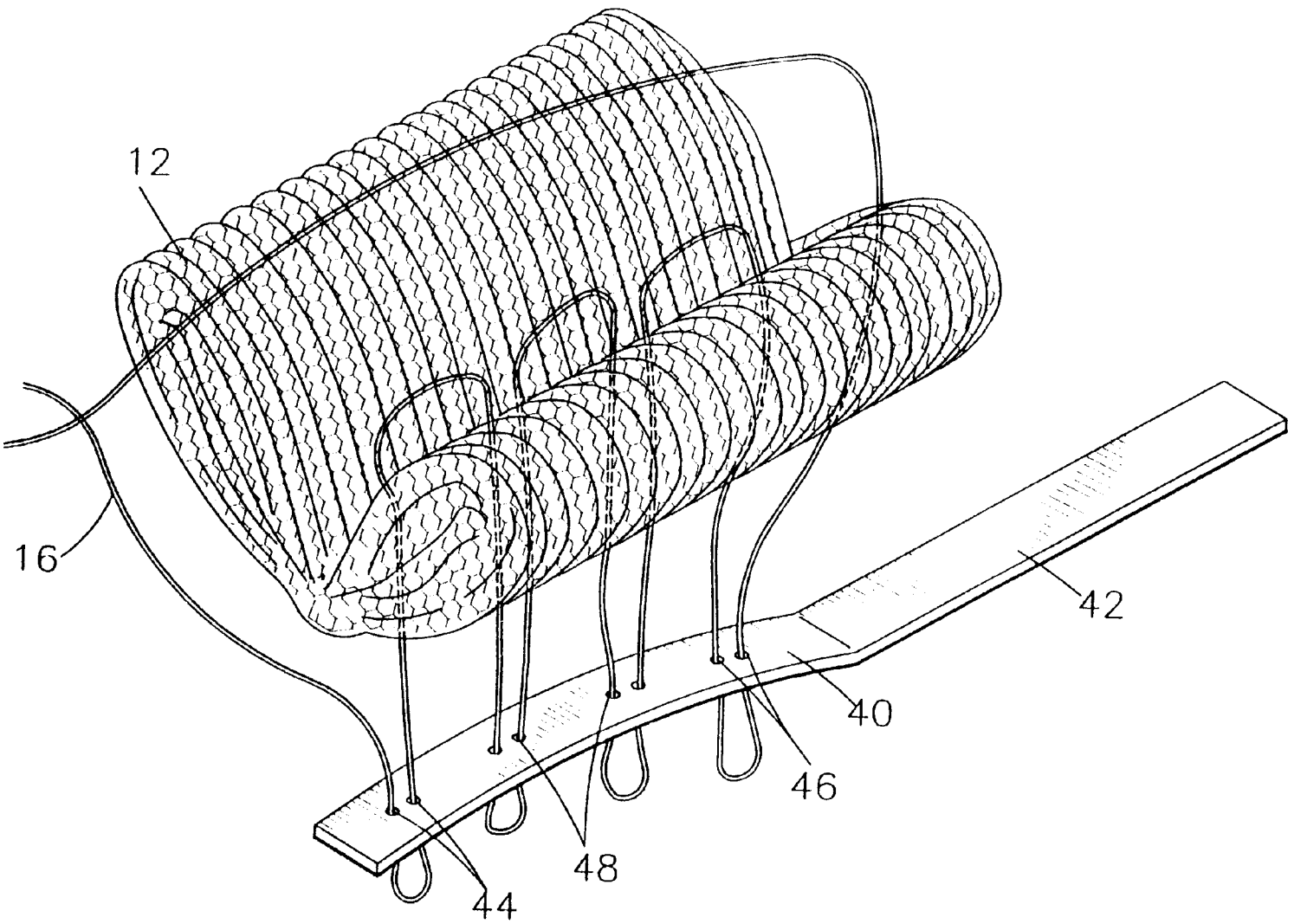
FIG. 10 is a perspective view of a sixth embodiment of the present invention.

Please refer to FIG. 10. The first, second and third fixing portions 44, 46, 48 are all two through holes arranged side by side along the length of the flat board section 40. Therefore, the elongated binding member 16 can be continuously conducted through the through holes and fixedly attached to the elastic mesh 12 on the flat board section 40. Instead of the thin cloth 11 seamed on the elastic mesh 12 as shown in FIG. 9, alternatively, the first, second and third fixing portions 44, 46, 48 can be such spaced that the binding members 16 are directly seamed on the grip member 14 so that the bath brush 10 can be produced by automatized measure.

The above embodiments are only used to illustrate the present inventions not intended to limit the scope thereof. Many modifications of the above embodiments can be made without departing from the spirit of the present invention.

What is claimed is:

1. A bath brush comprising:

an elastic mesh tube having a predetermined length and diameter, the mesh tube being axially pushed and compressed, whereby the circumference thereof is continuously waved and crimped;

a grip member disposed on an outer side of the elastic mesh tube, the grip member being disposed with a first fixing portion and a second fixing portion spaced from each other by a predetermined distance and at least one third fixing portion between the first and second fixing portions, the first, second and third fixing portions being substantially linearly arranged in a direction parallelly to the axis of the mesh tube; and a binding member having a predetermined length and flexibility and formed with a first and a second binding section spaced from each other by a predetermined distance, a pressing section between the first and second binding sections and at least one third binding section disposed on the pressing section, the third binding section corresponding to the third fixing portions in number, whereby the first binding section serves to fix a part of one end of the mesh tube on the first fixing portion and the second binding section serves to fix a part of the other end of the mesh tube on the second fixing portion, while the pressing section serves to press a middle portion of the mesh tube against a section of the grip member between the first and second fixing portions, the third binding section serving to fix the pressing section on the corresponding third fixing portion.

2. A bath brush as claimed in claim 1, wherein the pressing section is disposed on the outer side of the mesh tube opposite to the grip member, serving to compress the middle portion of the mesh tube toward the grip member, whereby the circumference of the mesh tube is squeezed into a left and a right half which are expanded respectively with the first and second binding sections and the pressing section as the centers.

3. A bath brush as claimed in claim 1, wherein a part of the third binding section is conducted over the outer side of the pressing section and then two ends of the third binding section are respectively passed through the mesh tube to meet each other and connect with the third fixing portion.

4. A bath brush as claimed in claim 1, wherein at least one third fixing portion includes a through hole passing through two lateral sides of the grip member.

5. A bath brush as claimed in claim 1, wherein each third fixing portion is a pair of through holes passing through two lateral sides of the grip member.

6. A bath brush as claimed in claim 1, wherein the third binding section is conducted to circle the pressing section and outer side of the mesh tube and then two ends of the third binding section meet each other and connect with the third fixing portion.

7. A bath brush as claimed in claim 6, wherein each third fixing portion includes two notches formed on the edges of the grip member.

8. A bath brush as claimed in claim 1, wherein the grip member includes a flat board section disposed with the first, second and third fixing portions and a handle section extending from the flat board section in a predetermined direction.

9. A bath brush as claimed in claim 8, wherein the flat board section has a predetermined length and the handle section has an arch recessed shape facing the flat board section, two ends of the handle section being connected with two ends of the flat board section in a bridge pattern.

10. A bath brush as claimed in claim 9, wherein the conjunctions between the flat board section and two ends of the handle section are respectively positioned between the first and second fixing portions and the third fixing portion.

11. A bath brush as claimed in claim 9, further comprising an extension bar, two ends of the handle section being respectively formed with two through holes for a predetermined section of the extension bar to pass therethrough.

12. A bath brush as claimed in claim 11, wherein the extension bar is formed with two projections spaced from each other by a predetermined distance and a bending section between the two projections, the projections being respectively positioned on outer sides of the handle section relative to the flat board section.

13. A bath brush as claimed in claim 1, wherein a thin cloth is previously fixed on the elastic mesh tube and positioned between the elastic mesh tube and the grip member.

14. A bath brush as claimed in claim 13, wherein the thin cloth is previously fixed on the elastic mesh tube by means of seaming.

* * * * *